US011614270B2

(12) United States Patent
Briem et al.

(10) Patent No.: US 11,614,270 B2
(45) Date of Patent: Mar. 28, 2023

(54) SUSPENSION DEVICE FOR A FOOD-ACCOMMODATING CONTAINER COMPRISING A PROFILED RAIL MADE OF METAL, ARRANGEMENT AND HOUSEHOLD REFRIGERATOR COMPONENT

(71) Applicant: BSH HAUSGERAETE GMBH, Munich (DE)

(72) Inventors: Robert Briem, Laichingen (DE); Stefan Deissler, Noerdlingen (DE); Marco Reitwiessner, Nuremberg (DE); Ralph Staud, Munich (DE); Thomas Tischer, Haar (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/470,074

(22) Filed: Sep. 9, 2021

(65) Prior Publication Data

US 2022/0082320 A1 Mar. 17, 2022

(30) Foreign Application Priority Data

Sep. 15, 2020 (DE) ..... 10 2020 211 570.2

(51) Int. Cl.

| | |
|---|---|
| ***F25D 23/04*** | (2006.01) |
| ***A47B 96/06*** | (2006.01) |
| ***F25D 25/00*** | (2006.01) |

(52) U.S. Cl.

CPC ..... *F25D 23/04* (2013.01); *A47B 96/067* (2013.01); *F25D 25/005* (2013.01); *F25D 2331/809* (2013.01)

(58) Field of Classification Search

CPC .. F25D 23/04; F25D 25/005; F25D 2331/809; F25D 23/02; F25D 23/067; F25D 25/04; F25D 25/025; F25D 23/066; F25D 11/00; F25D 23/028; A47B 96/067

See application file for complete search history.

(56) References Cited

U.S. PATENT DOCUMENTS

| | | | | |
|---|---|---|---|---|
| 3,437,214 A * | 4/1969 | Sainsbury | ..... | A47B 96/067 211/90.04 |
| 3,712,698 A * | 1/1973 | Propst | ..... | A47B 88/407 312/351 |
| 3,759,297 A | 9/1973 | Anderson et al. | | |

(Continued)

FOREIGN PATENT DOCUMENTS

| | | |
|---|---|---|
| DE | 7247687 U | 6/1976 |
| DE | 19700695 A1 | 8/1998 |

(Continued)

*Primary Examiner* — Hiwot E Tefera

(74) *Attorney, Agent, or Firm* — Laurence A. Greenberg; Werner H. Sterner; Ralph E. Locher

(57) ABSTRACT

A suspension device enables a freely projecting suspension of a food-accommodating container. The suspension device has a central rail for the direct suspension of the food-accommodating container. The central rail is a profiled rail made of metal. There is also described an arrangement of a suspension device with a food-accommodating container suspended in a freely projecting manner on the profiled rail, and a household refrigerator component.

12 Claims, 7 Drawing Sheets

(56) References Cited

U.S. PATENT DOCUMENTS

| | | | | |
|---|---|---|---|---|
| 4,320,935 | A * | 3/1982 | Nagelkirk | F16B 2/20 312/351 |
| 5,403,083 | A * | 4/1995 | Dasher | F25D 25/02 312/270.3 |
| 2007/0252498 | A1 | 11/2007 | Wing | |
| 2010/0025552 | A1* | 2/2010 | Joines-Novotny | A47B 96/067 248/220.21 |
| 2011/0309732 | A1 | 12/2011 | Horil et al. | |
| 2016/0290706 | A1* | 10/2016 | Rackley | F25D 11/00 |
| 2017/0234604 | A1* | 8/2017 | Eicher | A47B 96/027 312/330.1 |
| 2018/0132610 | A1* | 5/2018 | Lu | A47B 61/003 |
| 2018/0132611 | A1* | 5/2018 | Lu | A47B 61/003 |

FOREIGN PATENT DOCUMENTS

| | | | |
|---|---|---|---|
| DE | 102009002059 | A1 | 10/2010 |
| DE | 102009045058 | A1 | 3/2011 |
| DE | 102016202190 | A1 | 8/2017 |
| JP | 2006230544 | A | 9/2006 |
| WO | 2014197224 | A1 | 12/2014 |

* cited by examiner

SUSPENSION DEVICE FOR A FOOD-ACCOMMODATING CONTAINER COMPRISING A PROFILED RAIL MADE OF METAL, ARRANGEMENT AND HOUSEHOLD REFRIGERATOR COMPONENT

CROSS-REFERENCE TO RELATED APPLICATION

This application claims the priority, under 35 U.S.C. § 119, of German patent application DE 10 2020 211 570.2, filed Sep. 15, 2020; the prior application is herewith incorporated by reference in its entirety.

BACKGROUND OF THE INVENTION

Field of the Invention

One aspect of the invention relates to a suspension device for the freely projecting suspension of a food-accommodating container. The suspension device has a central rail for the direct suspension of a food-accommodating container. A further aspect of the invention relates to an arrangement comprising such a suspension device and a food-accommodating container. A further aspect of the invention relates to a household refrigerator component.

In household refrigerators it is known that separate food-accommodating containers, or simply food containers, are positioned in a defined manner in a household refrigerator component. In particular, a freely projecting suspension on a suspension device is provided to this end. A freely projecting suspension means in this context that the food-accommodating container is suspended only in this suspension device and is not held downwardly by a further component or, respectively, is not positioned on such a component. Thus the positioning of the food-accommodating container is achieved, in particular, only by this suspension.

In this context, suspension devices which are arranged, for example, on an inner face of a door of a household refrigerator are also known. As a result, a door tray which constitutes a food-accommodating container may be suspended thereon. Such a design is disclosed, for example, in the commonly assigned German published patent application DE 10 2009 045 058 A1. The suspension strip therein is configured from plastics material. As a result, the stability and the load-bearing force are reduced. Moreover, the suspension strip is limited in terms of shape. Thus the usability and applicability in different household refrigerator components is also limited.

A suspension device for the freely projecting suspension of a food-accommodating container is also disclosed in international published patent application WO 2014/197224 A1. The rail in that document is also configured from plastics.

BRIEF SUMMARY OF THE INVENTION

It is accordingly an object of the invention to provide a device which overcomes the above-mentioned disadvantages of the heretofore-known devices and methods of this general type and which provides for a suspension device having a more stable configuration. In particular, the usability and thus the applicability for very different purposes is intended to be improved.

With the above and other objects in view there is provided, in accordance with the invention, a suspension device for the freely projecting suspension of a food-accommodating container, the suspension device comprising:

a central rail configured for directly suspending the food-accommodating container therefrom;

the central rail being a profiled rail made of metal.

In other words, a first aspect of the invention relates to a suspension device for the freely projecting suspension of a food-accommodating container. The suspension device has a central rail. The central rail is configured for the direct suspension of at least one such food-accommodating container. The suspension is possible in a non-destructive, releasable manner. Thus the food-accommodating container may be suspended in a reversible manner and removed again. This central rail is a profiled rail. This means that it is not only a flat plate but that it is configured as a shaped profile. Thus it is a three-dimensional shaped body. As a result, the stiffness of the central rail is improved per se. In particular, by means of this design the capacity for coupling to further components is also improved. As a result, the usability is also improved and the application options are increased. This profiled rail is configured from metal. In particular in addition to the aforementioned advantages, this material design also permits the individual design of the visual appearance of the suspension device. In particular in a design made of metal, in combination with the design of a profiled rail, relatively thin wall thicknesses, but still having greater stability and stiffness, may be achieved. In particular, this central rail, on which the freely projecting suspension of the food-accommodating containers thereon or, respectively, therein is to be carried out as intended, also makes it possible to be able to suspend these food-accommodating containers optimally horizontally thereon. Since this central rail also has a greater torsional stiffness, therefore, a tilting of the suspended food-accommodating container slightly obliquely downwardly is also avoided. This is the case, in particular, when the food-accommodating container is filled with storage items.

In one exemplary embodiment the profiled rail is produced in one piece. Thus savings may be made in terms of assembly costs. Moreover, due to the one-piece production the profiled region of this central rail is also able to be generated in a very precise and dimensionally accurate manner. Not least the mechanical stability is particularly advantageous due to this one-piece design.

In one exemplary embodiment the profiled rail is a roll-formed profile. Where the rail is made of metal, such a roll-formed profile is able to be produced in a relatively simple manner. Even in the case of more complex profile shapes, this roll-forming is advantageous. For example, the more complex shape of the profiled part in the form of the profiled rail may be produced by this roll-forming from a planar plate made of metal, for example a sheet metal plate. In particular, as a result, the one-piece design is possible in a manner which is very advantageous and dimensionally accurate. Thus a roll-formed profile as a profiled rail constitutes a particularly advantageous exemplary embodiment.

In one exemplary embodiment, the profiled rail is configured from stainless steel. This exemplary embodiment is particularly advantageous for the use of the suspension device in very different environmental conditions, such as may be the case in a household refrigerator. Since in this case significant temperature differences and/or humidity differences may also potentially occur, with such a design consisting of stainless steel, for example, a high level of corrosion resistance is also achieved.

In one exemplary embodiment this profiled rail is of linear configuration. This means that it has a longitudinal axis which is rectilinear.

In particular, the central rail is designed as a profiled bar or profiled shelf. This means that it has a length which is greater, in particular is greater by a multiple, than the height and the depth.

By means of the design of the central rail as a profiled rail, individual profile shapes may also be generated. This is relative to increasing the stability of the rail itself and also relative to improved options for the suspension of food-accommodating containers.

Thus in one exemplary embodiment it is possible that the profiled rail has a first upper hollow chamber. In this regard the upper hollow chamber is to be understood relative to the vertical direction of the suspension device. This first upper hollow chamber is integrally formed on an upper edge of a front plate of the profiled rail, in particular by roll-forming. This front plate is thus also a component of the profiled rail. When viewed in the depth direction of the suspension device, therefore, this front plate is arranged upstream of the hollow chamber. Thus a front visible component of the central rail is effectively formed by the front plate. This first upper hollow chamber is configured to the rear thereof. In particular, a front face of the front plate is of planar configuration. A particularly simple and yet positionally accurate suspension of a food-accommodating container may be achieved thereby.

In one exemplary embodiment, the profiled rail has a second lower hollow chamber which is different and spaced apart from the first upper hollow chamber. This second lower hollow chamber is integrally formed, in particular, on a lower edge of the front plate of the profiled rail, in particular by roll-forming. Starting from the front plate, the two hollow chambers extend to the rear in the depth direction of the suspension device. In particular, an upper defining wall of the first upper hollow chamber is arranged flush with the upper edge of the front plate. In particular, a lower defining wall of the second lower hollow chamber is arranged flush with the lower edge of the front plate.

In one exemplary embodiment, the two hollow chambers are arranged entirely to the rear of the front plate. This means that, when viewed in the vertical direction, the two hollow chambers do not project upwardly and downwardly over the front plate. A profiled rail of compact construction is achieved thereby. Moreover, by means of this design it is also possible that, for example, the upper defining wall of the first upper hollow chamber also serves as a bearing wall and a suspension wall for a food-accommodating container. Thus a food-accommodating container is suspended not only on a very thin line or, respectively, on an edge which is formed by the upper edge of the front plate but on a larger bearing surface relative thereto. A stable positioning is improved thereby.

In one exemplary embodiment, in particular, the two hollow chambers extend without interruption over the entire length of the front plate. The advantages relative to the stabilization, on the one hand, and the capacity for potentially coupling to other components of the suspension device are improved thereby.

In one exemplary embodiment, at least one of the hollow chambers is configured to be multi-sided, in particular defined on at least three sides, in particular defined on four sides, in cross section perpendicular to a longitudinal axis of the profiled rail. In one exemplary embodiment, at least one hollow chamber is configured to be open in such a cross section. In particular, this cross-sectional geometry of a hollow chamber is thus formed with four sides but this cross-sectional contour is not fully closed in the peripheral direction. Thus, on the one hand, a high level of stability is achieved and, on the other hand, a certain deformation elasticity of the cross-sectional geometry of the hollow chamber is possible. In particular, therefore, the freely projecting leg which forms one side of this four-sided geometry may also flex to a certain extent. Thus improved fastenings of the suspension device to a household refrigerator component may also be achieved. It is thus possible to compensate for production tolerances in an improved manner by means of this design.

In particular, the two hollow chambers are correspondingly configured relative thereto.

In one exemplary embodiment, when viewed in the depth direction of the suspension device, the first upper hollow chamber is configured with a smaller depth than the lower hollow chamber. This has advantages in that a suspension of a food-accommodating container in the depth direction may also be possible in a very space-saving manner. On the one hand, the stiffness of the profiled rail may be increased in a particularly advantageous manner by the deeper lower second hollow chamber relative thereto. On the other hand, a free space, in which suspension elements of the food-accommodating container may be engaged, is also created by the first upper hollow chamber which is reduced in the depth direction relative thereto. In particular, therefore, in one exemplary embodiment advantageously such a suspension element of a food-accommodating container does not project to the rear in the depth direction over the extent of the lower second hollow chamber. This is achieved by a depth-reducing first and upper hollow chamber. A space-saving arrangement of the suspension device is also possible thereby. Nevertheless, a food-accommodating container may be suspended and removed again in a simple and user-friendly manner. An undesired projection of such a food-accommodating container over the profiled rail to the rear is avoided thereby.

In one exemplary embodiment, when viewed in the direction of its longitudinal axis, the profiled rail has an open design at a first end. This open end is configured as an insertion holder for an additional holding part of the suspension device. Additionally or alternatively, when viewed in the direction of this longitudinal axis, the profiled rail is configured so as to be open at a second end. This open end is configured in one exemplary embodiment as an insertion holder for an additional holding part of the suspension device. Thus these open ends are formed as intended as coupling points for these holding parts. This is a further very advantageous exemplary embodiment. Thus a suspension device consisting of a plurality of separate components may be constructed. Such a modular concept is particularly advantageous for forming variants of a suspension device. Thus, for example, a central component in the form of the profiled rail may be provided as the same component for different variants. The holding parts may thus be individually designed. This may be dependent on where the suspension device is to be accommodated or, respectively, fastened. Moreover, by means of such a design it is also possible to exchange or replace the respective individual parts of such a suspension device individually and in a simpler manner. In particular, variants of the suspension device may also be formed by the same holding parts but, for example, with central rails of different lengths.

This design is also particularly advantageous in that material differences may be made between the profiled rail and the holding parts. The holding parts may be one-piece components. They may be configured, for example, from plastics. In particular, they may be injection-molded components, for example.

The open ends may be configured in terms of their function as insertion holders for inserting the holding parts. However, the open ends may also be provided, for example, for snap-fitting such holding parts.

In one exemplary embodiment, these insertion holders are formed at the ends of the profiled rail by the hollow chambers which are open to the side. Thus these hollow chambers have a multi-functionality. Thus no further separate elements which would permit this holding function are required.

In one exemplary embodiment, the suspension device has at least one holding part. This holding part is configured, in particular, so as to be L-shaped. A leg of this L-shape is an insertion part which may be inserted into the profiled rail for holding the holding part on the profiled rail. In particular, a further leg of this L-shape is a coupling part. This coupling part is provided for coupling to a household appliance component as intended. In particular, to this end the coupling part may have, for example, an integrated holding cam or, respectively, coupling cam. This may be configured in a U-shaped manner. However, for example, a coupling receiver or, respectively, a coupling cam receiver may also be provided. Thus a holding cam or, respectively, coupling cam configured on the household appliance component may engage therein and may be mechanically coupled thereto. In particular, the insertion part of this holding part may be inserted into the interior of the profile of the profiled rail. Thus this insertion part may be also be arranged so as to be concealed in the mechanically connected state to the profiled rail.

In this context a profiled rail is not only one which has at least one hollow region which is open, in particular, on the end side as a profile. Such a hollow region may, for example, be a hollow chamber.

In one exemplary embodiment, the holding part has a rear edge wall. In the mounted state of the holding part on the profiled rail, when viewed in the width direction of the suspension device (i.e., in the longitudinal and length direction of the profiled rail), a rear wall of the upper first hollow chamber is arranged flush with an upper wall region of this rear edge wall. This means that in this width direction a stepless transition is configured between the rear edge wall of the holding part and the rear wall of the upper hollow chamber. This is very advantageous in that a food-accommodating container may be arranged with a suspension element in the width direction such that this suspension element may engage in an overlapping manner behind the interface between the rear edge wall and the rear wall of the upper hollow chamber in the width direction. Thus such a food-accommodating container may also be positioned to a maximum extent to the side in the width direction. In this context, the food-accommodating container may also be arranged so as to bear directly against an inner face of such a holding part. Thus the clear width of the suspension device between the two opposing holding parts may be used to a maximum extent.

In the mounted state of the holding part on the profiled rail, in one exemplary embodiment a rear wall of the lower second hollow chamber, when viewed in the width direction of the suspension device, is arranged flush with a lower wall region of this rear edge wall of the holding part. It is also achieved thereby that this holding part, when viewed in the depth direction, does not project to the rear over the profiled rail. An improved positioning and direct bearing of the suspension device on a household appliance component is possible thereby.

In one exemplary embodiment, when viewed in the vertical direction, this rear edge wall of the holding part is not of rectilinear configuration. In particular, when viewed over the entire height of the holding part, this rear edge wall is of stepped configuration. In this context, when viewed in the depth direction of the suspension device, an upper edge wall portion of this rear edge wall is arranged further forward than a lower edge wall portion of this rear edge wall, when viewed in this vertical direction. In particular, the flush arrangement with the rear walls of the upper hollow chamber, on the one hand, and the lower hollow chamber, on the other hand, is possible thereby. In particular, this is the case when these hollow chambers have different depth dimensions.

In one exemplary embodiment, the suspension device has the profiled rail and two holding parts which are separate therefrom. These holding parts, when viewed in the direction of the longitudinal axis of this profiled rail, are fastened directly thereto at opposing ends of the profiled rail. A U-shaped suspension device is configured by such a design. In particular, a U-shaped bracket is formed. This is a particularly advantageous shape of this entire suspension device. On the one hand, as a result it is stable and, on the other hand, it may be applied and used in very different ways. As a result, options are possible for fastening at very different positions, in particular, on household components. A defining element is also effectively formed by the holding parts on opposing sides, not least by means of this design. Potentially pushing a food-accommodating container too far in the width direction in the suspended state on the profiled rail is avoided thereby. These holding parts thus also form stops for the food-accommodating containers in the width direction.

A further aspect of the invention relates to an arrangement comprising a suspension device as claimed in the aforementioned aspect or an advantageous design thereof. The arrangement also has at least one food-accommodating container which is separate from the suspension device. This food-accommodating container has, in particular, a food-accommodating region and a suspension element. The food-accommodating container is able to be suspended directly on the profiled rail by means of this suspension element. In particular, the food-accommodating container is able to be suspended thereon in a freely projecting manner. This means that, as has already been described above, the food-accommodating container is no longer supported downwardly or, respectively, no longer sits or, respectively, is no longer positioned on an additional base. In particular, in this regard the food-accommodating container is suspended only on this profiled rail.

A further aspect of the invention relates to a household appliance component. In particular, this is a household refrigerator component. In particular, such a household refrigerator component is a door for a household refrigerator. This household refrigerator component has a suspension device as claimed in the aforementioned aspect or an advantageous design thereof. Additionally or alternatively, this household refrigerator component may have an arrangement according to the aforementioned aspect.

In particular, due to the design of the central rail as a roll-formed metal profile, for example made of stainless steel, aluminum or steel, an improvement of this suspension device is possible. The modularity due to these side caps, which are formed, in particular, from plastics and which constitute the holding parts, additionally assists this flexible system.

A very flexible adaptation to different desired widths of the suspension device is possible by means of this design of the suspension device. This is also the case, in particular, regarding different widths of household appliance components, in particular of doors. Only the central rail, which constitutes the individual component of the suspension device, has to be designed individually in terms of its length. Thus due to the very simple production, in particular as a roll-formed profile, this precise shaping is possible in a simple manner even with very different and individual lengths of this profiled rail.

Moreover, a very simple and flexible adaptation to different heights of holding bars which are generally configured on internal panels of doors of a household refrigerator is also possible. The suspension devices may be fastened in a simple manner to such vertically oriented bars. Thus by simply changing the holding parts it is also possible to adapt such a suspension device without difficulty to different bar specifications and thus to be able to fasten the suspension device thereto in a simple manner.

Moreover, by means of other holding parts adaptations to other shapes of holding parts, in particular holding cams, which are integrally formed on such bars of doors, are also possible. A very individual and flexible creation of variants is thus also achieved thereby. A coupling of such a holding element to the household appliance component with a corresponding holding element on a holding part of the suspension device is always achieved in a manner which is highly adapted and with an accurate fit, in particular a positive connection. In particular, in order to achieve this holding of the suspension device on the household appliance component, an adaptation may be carried out in a very flexible manner when this is a cam accommodating system.

Thus it is also possible to carry out a simple adjustment to other holding systems, such as for example to a ladder system on a rear wall of an internal container of a household refrigerator. As a result, the fastening to ribbed areas of such an internal container of a household refrigerator is also possible in a simple manner and is adaptable. Thus the suspension device, as already mentioned above, may be adjusted in the simplest manner and thus adapted as required to different purposes. This is possible, in particular, by the modular construction.

In particular, a unique visual appearance is also generated by means of the metal design of the profiled rail. Bending edges may generate optical reflections.

Since insertion holders may also be formed by means of the hollow chambers and the holding parts may engage internally in the hollow chambers, a maximum utilization of the width of the profiled rail is possible. The suspension of the food-accommodating containers, even as far as the ends of the profiled rail, thus may be carried out without difficulty.

In particular, it is provided that the holding parts are engaged positively and non-positively in the insertion holders of the profiled rail and correspondingly coupled. A contact pressure may be applied by the hollow chamber width and also by a type of overbending, so that when inserting the holding part this hollow chamber is bent upwardly to a certain extent and thus not only a plug connection but also at least one clamped connection is generated. In particular, by means of a design of the suspension device as has been described above, post-treatments of the profiled rail which is made of metal are also possible in a simple manner. Due to the flush interfaces between the holding part and the profiled rail, even undesired potentially sharp edges of the metal profile may be concealed. Thus a deburring of such edges of the metal profile may also be dispensed with. Since such edges are not exposed, an undesired effect when touched may also be avoided.

In one exemplary embodiment, it is provided that the profiled rail, in particular, is slightly tilted with its front plate relative to a vertical plane. In particular, this tilting is also implemented relative to the holding parts. In particular, a required draft angle of the food-accommodating containers may be compensated thereby. As a result, these food-accommodating containers are able to be suspended practically horizontally on the suspension device under these conditions.

In particular, due to the rear geometry of the holding part, in particular with the above-mentioned stepped rear edge wall, an improved support of the entire suspension device is also possible at this transition region of the holding part between the aforementioned legs of the L-shape and the household appliance component. In particular, therefore, a bearing over a greater surface area is possible, in particular in some cases a more positive bearing of this holding part on a bar and on a rear wall of the door.

Other features which are considered as characteristic for the invention are set forth in the appended claims.

The positions and orientations provided when the suspension device is used as intended and positioned as intended are specified by the terms "top" and "bottom," "front" and "rear," "horizontal," "vertical," "depth direction," "width direction," and "height direction."

Further features of the invention are disclosed in the claims, the figures and the description of the figures. The features and combinations of features mentioned above in the description and the features and combinations of features mentioned hereinafter in the description of the figures and/or shown individually in the figures are not only able to be used in the respectively specified combination but also in other combinations or individually without departing from the scope of the invention. Thus embodiments which are not explicitly shown and described in the figures, but which are revealed and able to be generated from the described embodiments by separate combinations of features, are also to be regarded as encompassed and disclosed by the invention. Thus embodiments and combinations of features which do not have all of the features of an originally formulated independent claim are also to be regarded as disclosed.

Although the invention is illustrated and described herein as embodied in a suspension device for a food-accommodating container comprising a profiled rail made of metal, arrangement and household refrigerator component, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Elements which are identical or functionally identical are provided in the figures with the same reference numerals throughout.

DETAILED DESCRIPTION OF THE INVENTION

Figure 1:
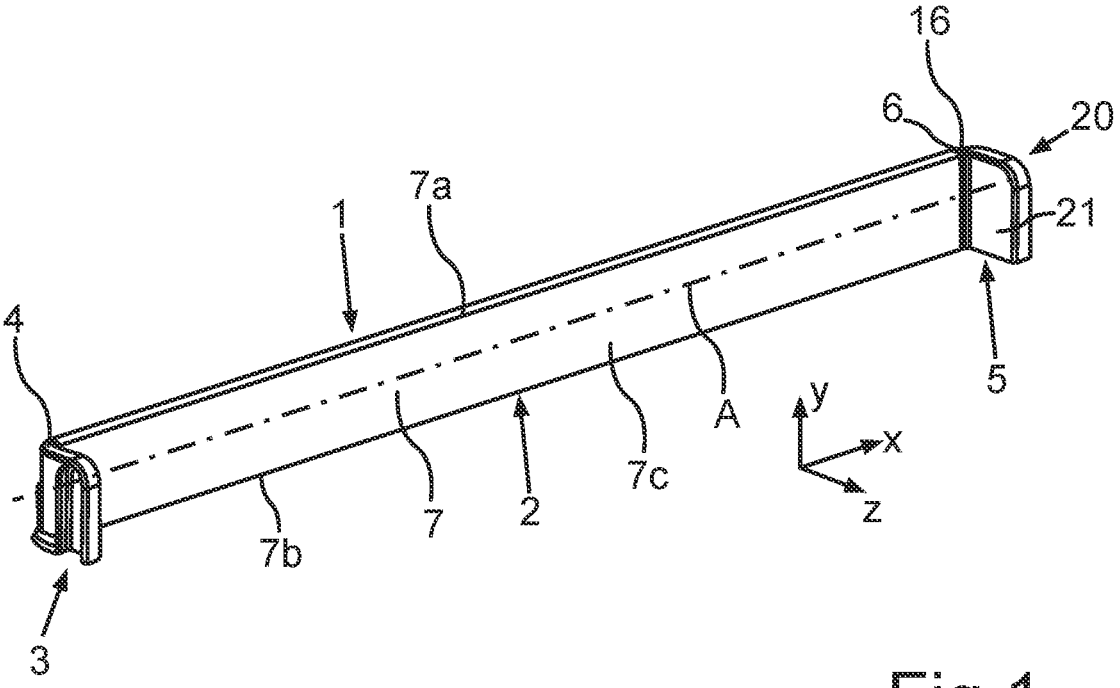
FIG. 1 shows a perspective (or axonometric) view of an exemplary embodiment of a suspension device according to the invention.

Referring now to the figures of the drawing in detail and first, in particular, to FIG. 1 thereof, there is shown a suspension device 1 in a perspective view. The suspension device 1 is provided as intended for the freely projecting suspension of a food-accommodating container. In the second exemplary embodiment the suspension device 1 has a central rail for directly suspending a food-accommodating container thereon or, respectively, therein. This central rail is a profiled rail 2. The profiled rail 2 is configured from metal. The profiled rail 2 has a longitudinal axis A. The profiled rail 2 is configured in a linear manner. The profiled rail 2 is produced in one piece. The profiled rail is a roll-formed profile in the exemplary embodiment. Thus, in particular, it is entirely bent into shape by roll-forming from a plate strip. Preferably the profiled rail 2 is made of stainless steel.

Moreover, the suspension device 1 has a first holding part 3. The first holding part 3 is arranged on a first end 4 of the profiled rail 2, when viewed in the direction of the longitudinal axis A. The suspension device 1 also has a second holding part 5. The holding part 5 is arranged at a second end 6 opposing the first end 4 on the profiled rail 2 which is separate therefrom. In the exemplary embodiment the holding parts 3 and 5 in each case are one-piece components. The holding parts are configured, in particular, from plastics. These holding parts 3 and 5 which are separate from the profiled rail 2 are configured in the exemplary embodiment in an L-shaped manner in the direction of the longitudinal axis A of the entire suspension device 1. The holding parts are directly connected to the profiled rail 2. In this mounted end state the suspension device 1 has a U-shape.

Figure 2:
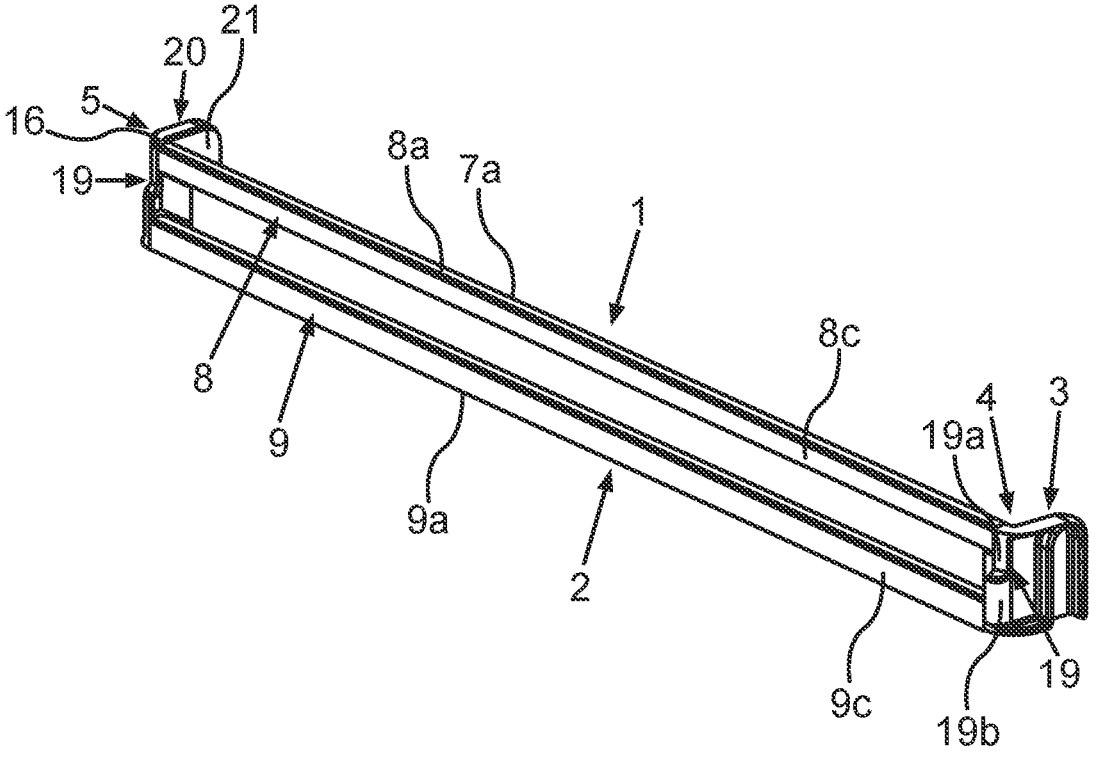
FIG. 2 shows the suspension device according to FIG. 1 in a different perspective from FIG. 1.

The suspension device 1 is shown in FIG. 2 in a different perspective from FIG. 1. The suspension device is shown in FIG. 2 from the rear. In this case, it may also be seen that the profiled rail 1 is a three-dimensional shaped component.

The profiled rail 2 has a front plate 7. The front plate 7 is configured without interruption. A first profiled region is configured so as to be integrally formed on this front plate 7. When viewed in the depth direction (z-direction) this profile region directly adjoins the thin front plate 7 to the rear. This profiled region is a hollow chamber 8. This is a first upper hollow chamber, when viewed in the vertical direction (y-direction).

Moreover, the profiled rail 2 has a second profiled region which is different from the first. In the exemplary embodiment this profiled region is a second lower hollow chamber 9. The hollow chambers 8 and 9 in each case have defining walls which in each case define the hollow space.

A profiled rail 2 is a component which has at least one open hollow region defined by walls.

As may be seen in FIG. 2 the two hollow chambers 8 and 9 are arranged entirely to the rear of the front plate 7. This means that in the vertical direction they do not project upwardly or downwardly over the extent of the front plate 7. When viewed in the width direction (x-direction, along the longitudinal axis A) of the suspension device, the hollow chambers 8 and 9 extend without interruption over the entire length of the front plate 7. As may also be seen in FIG. 2, an upper defining wall 8*a* of the first upper hollow chamber 8 is oriented horizontally. The upper defining wall directly adjoins an upper marginal edge 7*a* of the front plate 7.

Moreover, the lower hollow chamber 9 has a lower defining wall 9*a*. This lower defining wall on the front face adjoins a lower defining edge 7*b* (FIG. 1) of the front plate 7 or, respectively, terminates directly thereon.

As may also be seen in FIG. 2 the holding parts 3 and 5 are inserted into the profiled rail 2. Thus a positioning of the holding parts 3 and 5 fitted inside the profiled rail 2 is provided.

Figure 3:
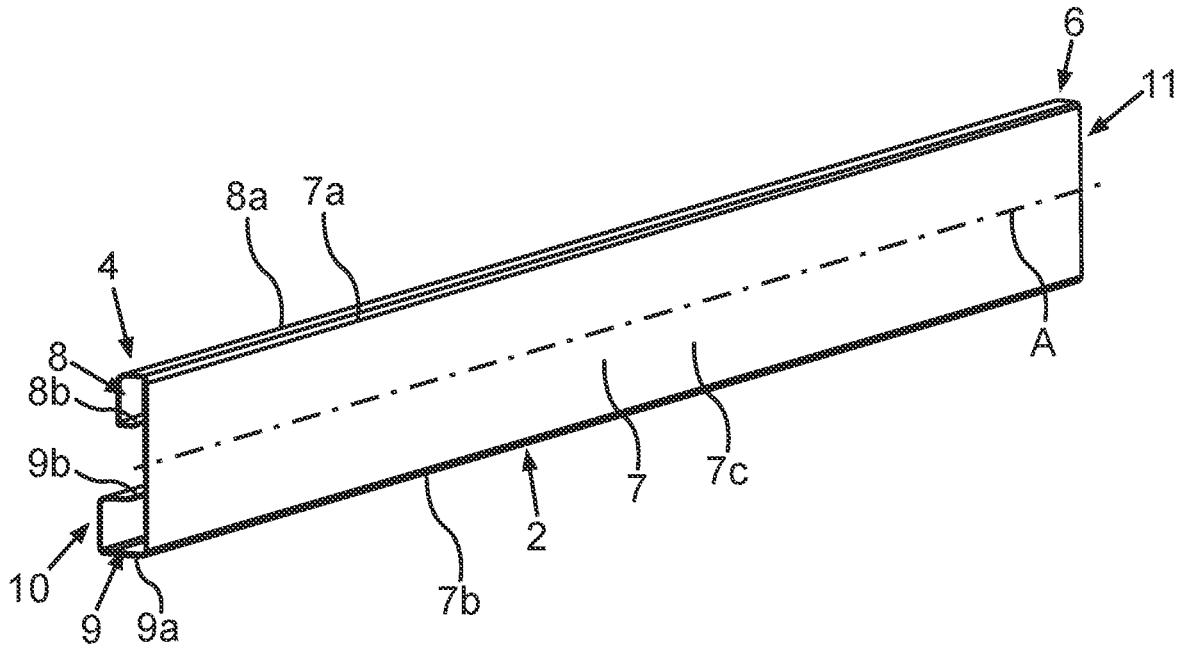
FIG. 3 shows a perspective view of an exemplary embodiment of a profiled rail made of metal of the suspension device according to FIGS. 1 and 2.

In FIG. 3 the profiled rail 2 is shown in an axonometric or perspective view. The hollow chambers 8 and 9 are evident on the side. As also shown in FIG. 3, in the exemplary embodiment the hollow chambers 8 and 9, when viewed in cross section perpendicular to the longitudinal axis A, are formed by a four-sided cross-sectional shape. Moreover, it may also be seen that this cross-sectional shape is not fully closed. Thus, in particular, in the upper hollow chamber 8 a lower defining wall 8*b* is open or, respectively, not configured directly adjoining the front plate 7. Moreover, an upper defining wall 9*b* of the lower hollow chamber 9 is arranged spaced apart from this front plate 7. Thus this lower hollow chamber 9, when viewed in cross section, is also not completely closed over the periphery.

Moreover in FIG. 2 and FIG. 3 in the exemplary embodiment it may be seen that in the depth direction (z-direction) the upper hollow chamber 8 has a smaller depth than the lower hollow chamber 9.

Moreover, it is also provided that the profiled rail 2 is configured to be open both at the first end 4 and at the second end 6. In particular, relative thereto the hollow chambers 8 and 9 are configured so as to be open at these opposing ends 4 and 6. On the one hand, a first insertion holder 10 and a second insertion holder 11 are configured integrally at these open ends of the hollow chambers 8 and 9. These insertion holders 10 and 11 are configured for accommodating and inserting and thus also holding the additional holding parts 3 and 5 as intended. These insertion holders 10 and 11 are thus in each case formed at the ends by the laterally open hollow chambers 8 and 9.

Figure 4:
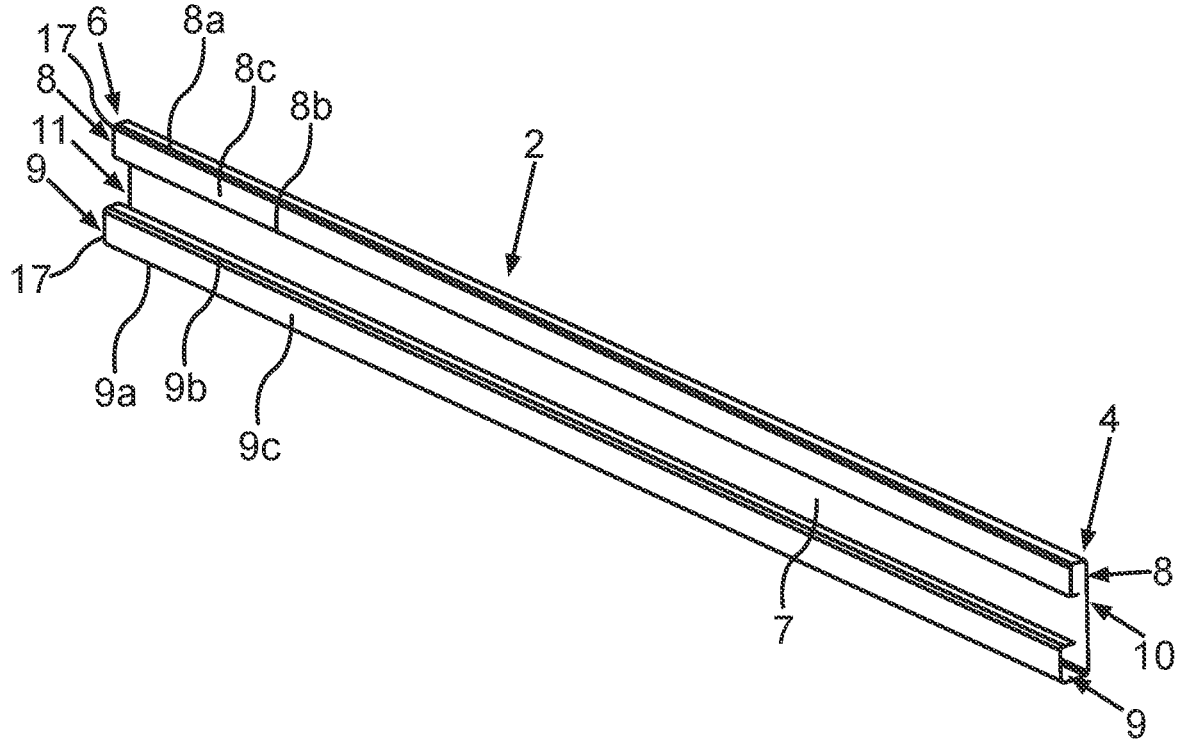
FIG. 4 shows the profiled rail according to FIG. 3 in a different perspective from FIG. 3.

In FIG. 4 the profiled rail 2 is shown in a different perspective from FIG. 3, similar to the different perspectives of FIGS. 1 and 2, respectively.

Figure 5:
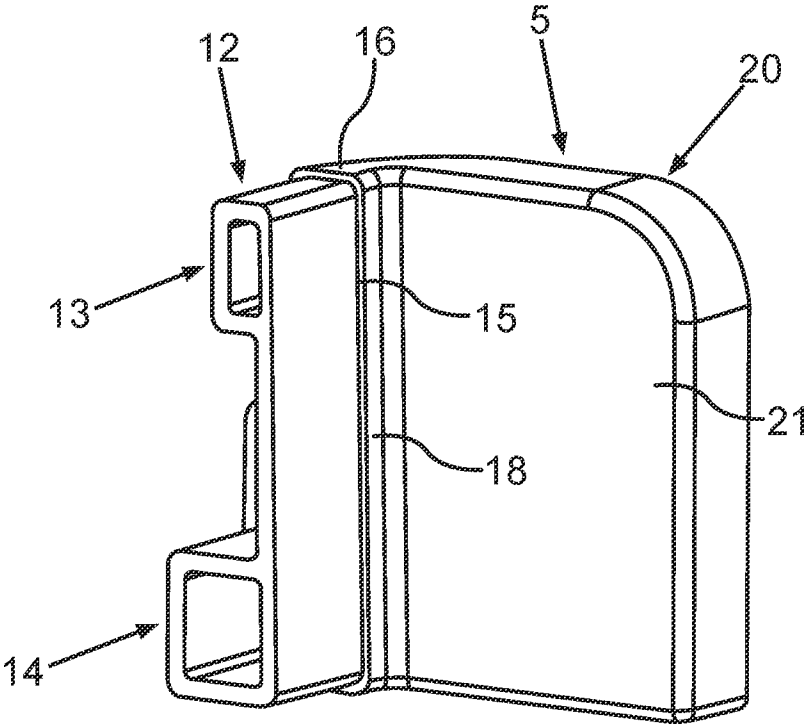
FIG. 5 shows a perspective view of an exemplary embodiment of a holding part of the suspension device according to FIG. 1 and FIG. 2.

In FIG. 5 an exemplary embodiment of the holding part 5 is shown in a perspective view. The L-shape may be seen here. A first leg of the L-shape 12 is an insertion part for inserting into an insertion holder 10, 11 of the profiled rail 2. This leg of the L-shape 12 has insertion elements 13 and 14. These insertion elements are also formed as hollow chambers. The insertion elements 13 and 14 are configured for insertion into the hollow chambers 8 and 9 with an accurate fit and, in particular, a positive and non-positive connection.

Moreover, it may also be seen that this leg of the L-shape 12 has a stop edge 15. This stop edge 15 is provided for directly abutting against a marginal edge 17 (FIGS. 3, 4) of the profiled rail 2 at the open end 6. In particular, by this design of the leg of the L-shape 12 a flush arrangement of the surface regions of the holding part 5 relative to the surface regions of the profiled rail 2 is also possible. In particular, therefore, in the mounted state a flush transition between an upper face 16 of the holding part 5 and the upper defining wall 8*a* of the upper hollow chamber 8 is possible. Moreover, a flush transition to an inner face 18 of the holding part 5, in particular of the leg of the L-shape 12, to a front face 7*c* (FIG. 3) of the front plate 7 is possible. Moreover, by this peripheral stop edge 15 a flush transition between a rear edge wall 19 (FIG. 2) of the holding parts 3 and 5 to the rear walls or, respectively, rear defining walls 8*c* and 9*c* of the hollow chambers 8 and 9 (FIG. 4) is also possible. This may also be seen in FIG. 2. Here the flush transitions between the upper face 16 and the upper defining wall 8*a* and the rear defining walls 8*c*, 9*c* to this rear edge wall 19 are shown. In FIG. 1 the flush transition between the front face 7*c* and the inner face 18 may be seen relative thereto.

Moreover, according to the view in FIG. 5 the holding part 5 has a further leg of the L-shape 20. This leg of the L-shape is oriented, in particular, at an angle of 90° to the leg of the L-shape 12.

As may also be seen in FIG. 2 in the exemplary embodiment in which the hollow chambers 8 and 9 have different depths, this rear edge wall 19, when viewed in the vertical direction, is not rectilinear. In particular a stepped shape is configured relative thereto. In this context, an upper edge wall portion 19*a* is arranged offset to the front relative to a lower edge wall portion 19*b*. Thus in this exemplary embodiment with the hollow chambers 8 and 9 of different depth the respective flush transition, when viewed in the width direction, is also possible between the rear defining walls 8*c* and this upper edge wall portion 19*a*, on the one hand, and the rear defining wall 9*c* and the lower edge wall portion 19*b*. The edge wall 19 is a rear region at the transition between the legs of the L-shape 12 and 20.

By this offset of the edge wall portions 19*a* and 19*b* it is also possible that a suspension element of a food-accommodating container may be pushed-on as far as possible outwardly in the width direction and thus in this case in the direction of the longitudinal axis A and thus in the vicinity of the holding part 3. In particular, therefore, a positioning of the food-accommodating container may be carried out which optionally also bears directly against an inner face 21 (FIG. 5) of the leg of the L-shape 20 projecting to the front. Thus the free space generated in the depth direction is formed to the rear of the upper edge wall portion 19*a* for positioning a suspension element of the food-accommodating container. The suspension element thus may be positioned such that it overlaps the interface between the hollow chamber 8 and the stop edge 15 in the width direction.

The further holding part 3 is configured according to the holding part 5, so that the descriptions made relative to the holding part 5 also apply to the holding part 3. Accordingly, therefore, in the figures the same reference numerals are also shown in the holding parts 3 and 5 for the respective individual components, where visible.

Figure 6:
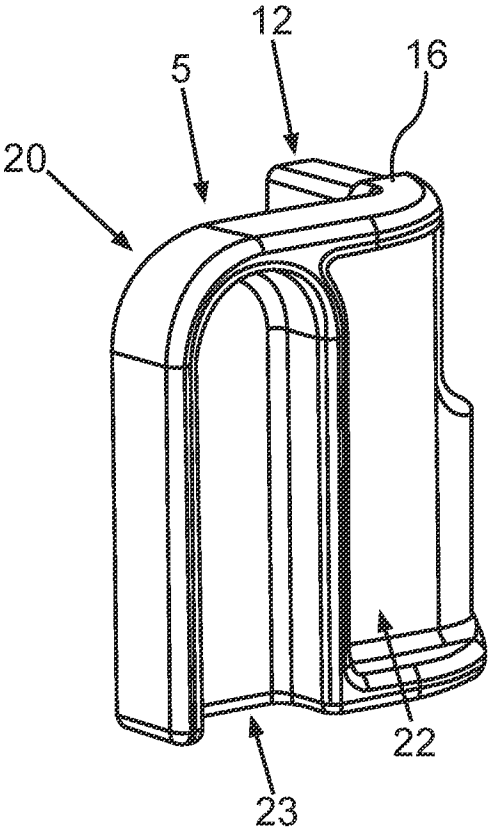
FIG. 6 shows the holding part according to FIG. 5 in a different perspective from FIG. 5.

In FIG. 6 the exemplary embodiment of the holding part 5 is shown in a different perspective from FIG. 5. It may be seen here that the forwardly projecting leg of the L-shape 20 has a coupling element 23 on an outer face 22. This is provided for the direct mechanical coupling to a counter coupling element which is integrally formed on a household appliance component. In particular, in the exemplary embodiment shown here this coupling element 23 is an integrated holding cam receiver. A holding cam which, for example, is integrally formed on a vertically oriented bar projecting in the depth direction to the rear from an internal panel of a door of the household refrigerator may engage therein. This holding cam engages in this holding cam receiver, in particular, with an accurate fit and thus also with a positive connection.

Figure 7:
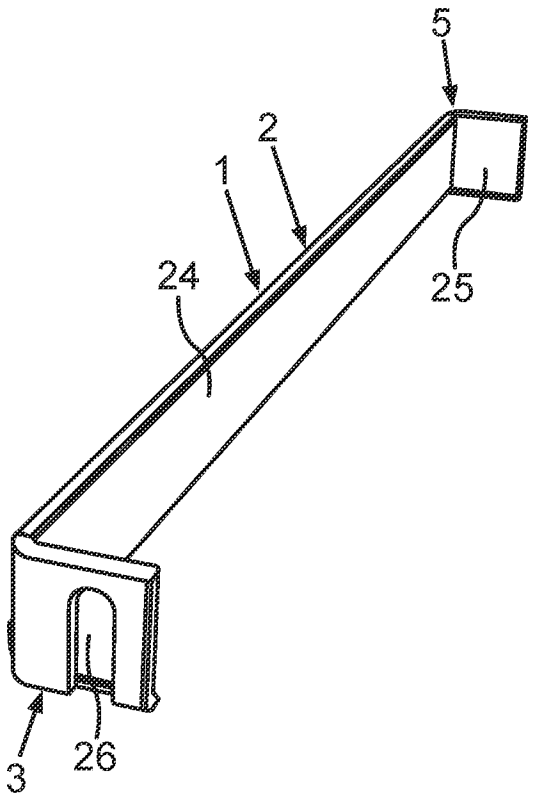
FIG. 7 shows a perspective view of a further exemplary embodiment of a suspension device according to the invention.

In FIG. 7 a further exemplary embodiment of a suspension device 1 is shown. In this exemplary embodiment, the profiled rail 2 is not exclusively configured in a linear manner as has been described in the preceding exemplary embodiments. Rather, the one-piece profiled rail 2 is configured here in a U-shaped manner. In each case, an accommodating part 25 and 26 is integrally formed on opposing ends by bending back, in particular roll-forming, a central rectilinear part 24. In this case, the suspension device 1 also has once again a U-shape. In particular, the suspension device 1 is also of modular construction here. The profiled rail 2 is also configured in one piece from metal in this case. In one exemplary embodiment, it is preferably provided that this central part 24 is a profiled part. According to the preceding embodiments, the central part may also have hollow regions. In particular, hollow chambers 8 and 9 may also be provided here. In this exemplary embodiment, the hollow chambers 8 and 9 may also be designed such that in contrast to the preceding exemplary embodiment the defining walls 8*b* and 9*b* are not present. Thus in this case the contours are not square but triangular, in particular U-shaped in cross section.

Figure 8:
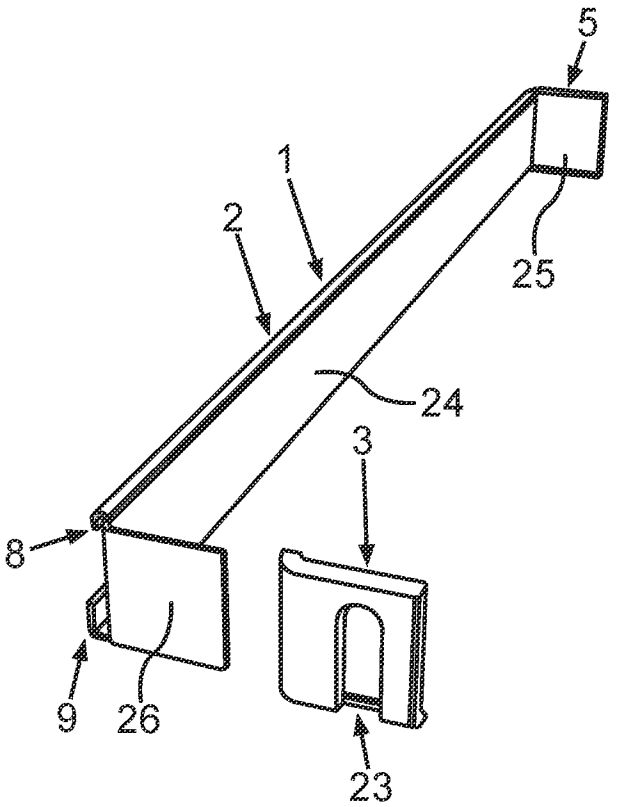
FIG. 8 shows an exploded view of partial components of the suspension device according to FIG. 7.

In particular, in this regard the upper hollow chamber 8 as may be seen in FIG. 8 is open downwardly. The lower hollow chamber 9 in this exemplary embodiment is completely open upwardly.

Once again holding parts 3 and 5 are also provided here. These holding parts 3 and 5 are separate components from the profiled rail 2. In this regard, the holding parts are fastened so as to be held on the accommodating parts 25 and 26. As may be seen here, the accommodating parts 25 and 26 are plate parts which are configured without interruption. In a similar manner to the holding part 5, the holding part 3 may be fastened, for example, in a non-destructive, releasable manner to the profiled rail 2. Here, for example, a plugging or snap-fitting to the parts 25 and 26 may be provided. In particular, an insertion into the hollow chambers 8 and 9 is additionally provided. In this regard, a plug connection, in particular a positive plug connection, may be provided. This plug connection may also be configured non-positively.

Figure 9:
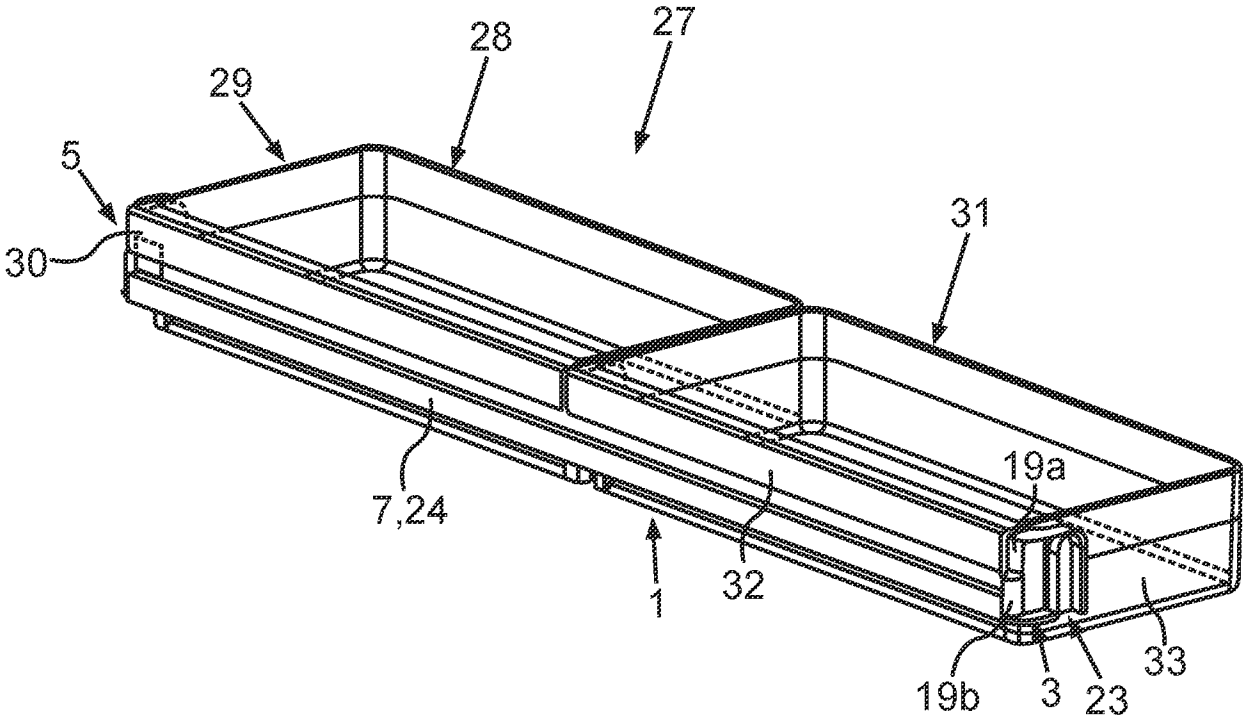
FIG. 9 shows a perspective view of an exemplary embodiment of an arrangement according to the invention comprising a suspension device and a plurality of food-accommodating containers.

Referring now to FIG. 9, there is shown an arrangement 27 according to the invention in a perspective view. The arrangement has a suspension device 1. This suspension device may be configured according to an exemplary embodiment as has been described. The arrangement 27 also has at least one food-accommodating container 28 separate therefrom. The food-accommodating container, or food container, may be configured as a tray. An accommodating region 29 is a component of this one-piece food-accommodating container 28. The food-accommodating container 28 also has a suspension element 30. The suspension element is integrally formed in one piece on a rear edge of the accommodating region 29. With this suspension element 30 the food-accommodating container 28 is suspended from above onto or, respectively, into the profiled rail 2. This freely projecting suspension of the food-accommodating container 28 may be seen.

In the exemplary embodiment according to FIG. 9 it may be seen that in this case two separate food-accommodating containers 28 and 31 are suspended on the suspension device 1. In this context, it may also be seen that a suspension element 32 of the food-accommodating container 31 projects into the free space to the rear of the upper edge wall portion 19*a*. This suspension element 32 terminates above the lower edge wall portion 19*b*, when viewed in the vertical direction. Moreover, it may also be seen here that a side wall 33 of the food-accommodating container 31 bears directly against the holding part 3 on the inner face. Thus the entire clear width between the two inner faces of the holding parts 3 and 5 may be used in order to position the food-accommodating containers 28, 31. The overlapping position of the suspension element 32, when viewed in the width direction, relative to the interface between the stop edge 15 and the marginal edge 17 is shown. The same is also configured, in particular, in the case of the suspension element 30.

Figure 10:
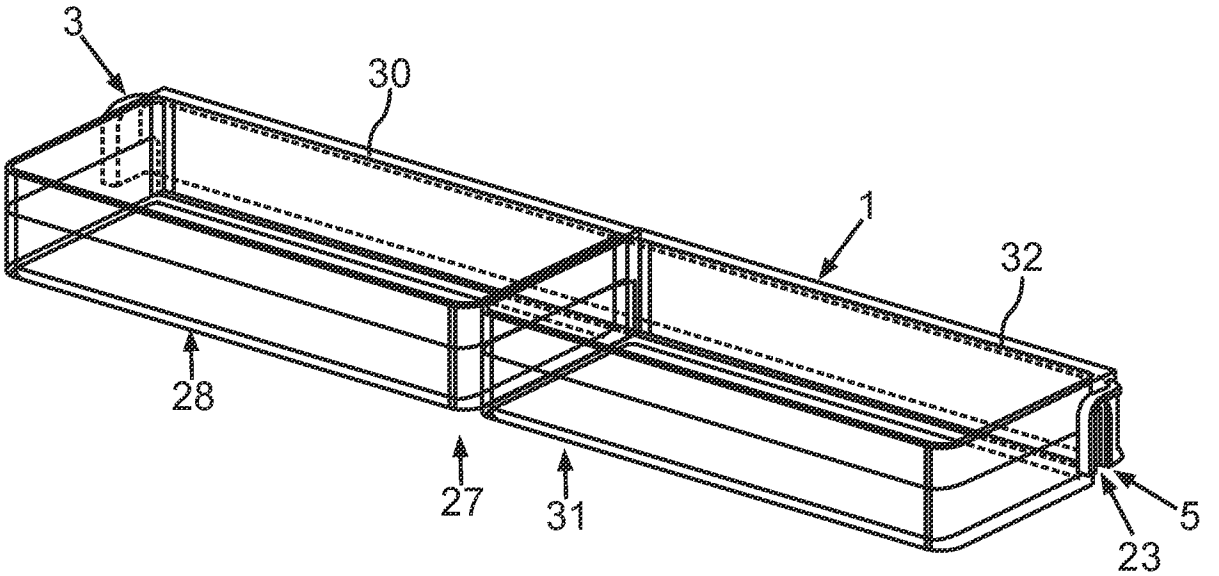
FIG. 10 shows the design of the arrangement according to FIG. 9 in a different perspective from FIG. 9.

In FIG. 10 the arrangement 27 according to FIG. 9 is shown in a reverse perspective relative to FIG. 9. In this context the food-accommodating containers 28 and 31 are viewed from the front.

Figure 11:
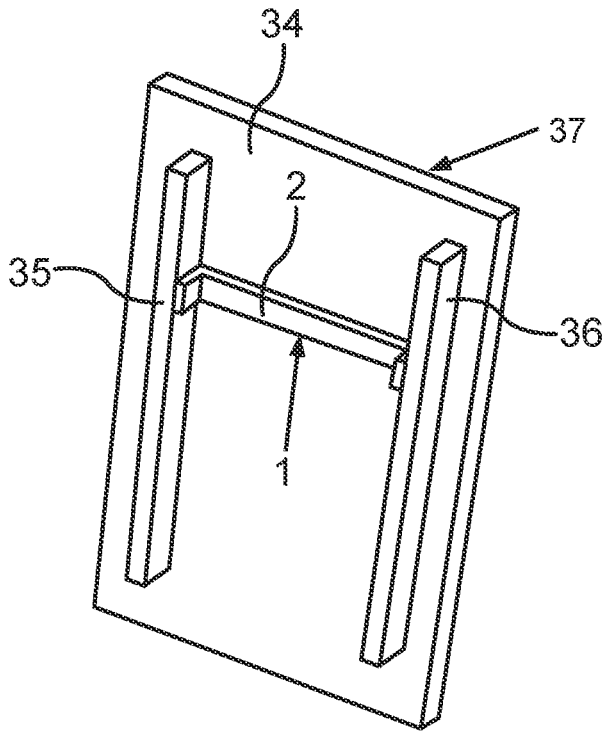
FIG. 11 shows a schematic view of an exemplary embodiment of household refrigerator component with an exemplary embodiment of a suspension device.

In FIG. 11 an exemplary embodiment of a household refrigerator component 37 according to the invention is shown. In this case, the household refrigerator component 37 is a door for a household refrigerator. In particular, the door has an internal panel 34, also referred to as a liner 34. This internal panel has bars 35 and 36 which are oriented vertically and arranged parallel to one another. The bars project from the plane of a base plate of the internal panel 34. The bars 35, 36 are configured in one piece with the internal panel 34. A suspension device 1 with a profiled rail 2, which are separate from the panel 34, are arranged on the internal panel 34. In particular, the suspension device 1 is fastened directly to the bars. The suspension device is fastened in a non-destructive, releasable manner thereto. To this end, holding cams which directly engage in holding cam receivers on the holding parts 3, 5 of the suspension device are integrally formed on the inner faces of the bars 35, 36.

The following is a summary list of reference numerals and the corresponding structure used in the above description of the invention:

1 Suspension device
2 Profiled rail
3 Holding part
4 End
5 Holding part
6 End
7 Front plate
7*a* Marginal edge
7*b* Lower edge
7*c* Front face
8 Hollow chamber
8*a* Defining wall
8*b* Defining wall
8*c* Defining wall
9 Hollow chamber
9*a* Defining wall
9*b* Defining wall
9*c* Defining wall
10 Insertion holder
11 Insertion holder
12 Leg of the L-shape
13 Insertion element
14 Insertion element
15 Stop edge
16 Upper face
17 Marginal edge
18 Inner face
19 Edge wall
19*a* Edge wall portion
19*b* Edge wall portion
20 Leg of the L-shape
21 Inner face
22 Outer face
23 Coupling element
24 Part
25 Accommodating part
26 Accommodating part
27 Arrangement
28 Food-accommodating container
29 Accommodating region
30 Suspension element
31 Food-accommodating container
32 Suspension element
33 Side wall
34 Internal panel
35 Bar
36 Bar
37 Household refrigerator component
x Width direction
y Vertical direction
z Depth direction
A Longitudinal axis

The invention claimed is:

1. A door for a household refrigerator having a suspension device for the freely projecting suspension of a food-accommodating container, the suspension device comprising:

a central rail configured for directly suspending the food-accommodating container therefrom; a first holding part and/or a second holding part;

said central rail being a profiled rail made of metal and being a roll-formed profile, and said profiled rail being formed with:

a first, upper hollow chamber being integrally formed on an upper edge of a front plate of said profiled rail, a second, lower hollow chamber being spaced apart from said first hollow chamber and integrally formed on a lower edge of said front plate of said profiled rail, and wherein, starting from said front plate, said first and second hollow chambers extend rearward;

along a longitudinal axis of said profiled rail, said profiled rail being formed with an open first end, and said open first end being configured as a first insertion holder for receiving said first holding part of the suspension device, and/or said profiled rail being formed with an open second end, and said open second end being configured as a second insertion holder for receiving said second holding part of the suspension device;

said first holding part and/or said second holding part being configured to fix the suspension device to the door of the household refrigerator, and said first holding part and/or said second holding part having insertion elements, said insertion elements being configured for insertion into said hollow chambers with a positive connection and a friction-lock connection.

2. The door according to claim 1, wherein said profiled rail is formed integrally in one piece.

3. The door according to claim 1, wherein said profiled rail is made of stainless steel.

4. The door according to claim 1, wherein said profiled rail is a linear rail.

5. The door according to claim 1, wherein each of said first and second hollow chambers is at least three-sided in cross section and is open in cross section.

6. The door according to claim 1, wherein, in a depth direction of the suspension device, said first, upper hollow chamber has a smaller depth than said second, lower hollow chamber.

7. The door according to claim 1, wherein said first insertion holder or second insertion holder is a hollow chamber that is laterally open in a direction of the longitudinal axis.

8. The door according to claim 1, wherein at least one of said first and second holding parts is formed as an L-shaped part, and wherein one leg of said L-shaped part is said insertion element for insertion into said profiled rail, which is separate from said first and second holding part, and a further leg of said L-shaped part has a coupling part for coupling to a household appliance component.

9. The door according to claim 1, wherein said first or second holding part is formed with a rear edge wall, wherein, in a mounted state of said first or second holding part on said profiled rail, a rear defining wall of said upper hollow chamber, when viewed in a width direction of the suspension device, is arranged flush with an upper edge wall portion of said rear edge wall and, in the mounted state of said first or second holding part on said profiled rail, a rear defining wall of said lower hollow chamber, when viewed in the width direction of the suspension device, is arranged flush with a lower edge wall portion of said rear edge wall.

10. The door according to claim 1, wherein said profiled rail and said first and second holding parts which are separate from said profiled rail and which are fastened at mutually opposite ends of said profiled rail form a U-shaped suspension device.

11. An arrangement, comprising a door according to claim 1 and at least one food-accommodating container suspended in a freely projecting manner on said profiled rail.

12. A household refrigerator component having a door according to claim 1, further comprising at least one food-accommodating container suspended in a freely projecting manner on the profiled rail of said suspension device.

* * * * *